US012668918B1

(12) United States Patent
Barry et al.

(10) Patent No.: US 12,668,918 B1
(45) Date of Patent: Jun. 30, 2026

(54) DIELECTRIC ROPE WITH SHEDS

(71) Applicant: BARRY CORDAGE LTD, Montreal (CA)

(72) Inventors: Peter Barry, Mount-Royal (CA); Patrick Barry, Etobicoke (CA)

(73) Assignee: Barry Cordage Ltd., Quebec (CA)

( * ) Notice: Subject to any disclaimer, the term of this patent is extended or adjusted under 35 U.S.C. 154(b) by 0 days.

(21) Appl. No.: 19/004,720

(22) Filed: Dec. 30, 2024

(51) Int. Cl.
*D07B 1/18* (2006.01)
*D07B 1/02* (2006.01)
*D07B 1/16* (2006.01)

(52) U.S. Cl.
CPC ..... *D07B 1/185* (2013.01); *D07B 1/02* (2013.01); *D07B 1/16* (2013.01); *D07B 2201/1096* (2013.01); *D07B 2201/2009* (2013.01); *D07B 2205/201* (2013.01); *D07B 2501/2076* (2013.01)

(58) Field of Classification Search
CPC . D07B 1/02; D07B 1/16; D07B 1/185; D07B 2201/1096; D07B 2201/2009; D07B 2205/201; D07B 2501/2076
See application file for complete search history.

(56) References Cited

U.S. PATENT DOCUMENTS 1,918,344 A 7/1933 Mau et al.
2,067,405 A 1/1937 Mayne
3,060,973 A 10/1962 Mlinar
3,067,570 A 12/1962 Nischan
3,192,312 A * 6/1965 Sauer ..... H01B 17/02 174/209
4,243,118 A 1/1981 Landry
4,391,088 A 7/1983 Salsky et al.
4,441,787 A 4/1984 Lichtenberger
4,445,321 A 5/1984 Hutchinson
4,534,163 A 8/1985 Schuerch
4,626,619 A 12/1986 Uematsu
4,952,262 A 8/1990 Washkewicz et al.
4,956,039 A 9/1990 Olesen et al.
5,064,490 A 11/1991 Chapin et al.
(Continued)

FOREIGN PATENT DOCUMENTS

AU 20047175 9/2000
CA 3203324 12/2023
(Continued)

OTHER PUBLICATIONS

Par Group; Aramid Fibre Cloth; Jun. 23, 2009; https://www.par-group.co.uk/high-temperature-insulation/aramid-fibre/ (2009); 2 pgs.

*Primary Examiner* — Shaun R Hurley
(74) *Attorney, Agent, or Firm* — Ryan Kromholz & Manion, S.C.

(57) ABSTRACT

A dielectric rope comprises a non-conductive core and an impermeable jacket disposed around the core and one or more sheds comprising either of a thermo-retractable shed permanently affixed or a first portion and a second portion configured to be secured to the first portion. When the first and second portion of the shed are secured to each other, the shed defines an aperture for receiving the rope therein. The dielectric rope with sheds dissipates electric streamers and improves personnel safety when working in contact with energised equipment.

20 Claims, 6 Drawing Sheets

(56) References Cited

U.S. PATENT DOCUMENTS

| | | | | |
|---|---|---|---|---|
| 5,446,242 | A * | 8/1995 | Barrett | H01B 17/14 174/140 R |
| 6,007,651 | A | 12/1999 | Ishino | |
| 6,062,014 | A | 5/2000 | Yeh | |
| 6,103,317 | A | 8/2000 | Asai et al. | |
| 6,167,650 | B1 | 1/2001 | Duback | |
| 6,179,008 | B1 | 1/2001 | Kawazura et al. | |
| 6,205,276 | B1 | 3/2001 | Anelli et al. | |
| 6,303,870 | B1 * | 10/2001 | Nazaryan | H01B 17/00 174/172 |
| 6,380,298 | B2 | 4/2002 | Flautt et al. | |
| 6,507,692 | B1 * | 1/2003 | Hoefner | G02B 6/442 385/136 |
| 6,999,641 | B2 | 2/2006 | Williams et al. | |
| 7,032,371 | B2 | 4/2006 | Smith et al. | |
| 7,180,000 | B2 | 2/2007 | Hager et al. | |
| 7,568,418 | B2 | 8/2009 | Kijesky | |
| 8,863,630 | B2 | 10/2014 | Erlendsson | |
| 9,416,489 | B2 | 8/2016 | Erlendsson | |
| 9,756,839 | B2 | 9/2017 | Nakanishi | |
| 10,153,069 | B2 | 12/2018 | Dalin et al. | |
| 10,370,909 | B2 | 8/2019 | Thomas et al. | |
| 10,532,342 | B2 | 1/2020 | Bouvier et al. | |
| 10,656,033 | B2 | 5/2020 | Campbell | |
| 10,991,488 | B2 * | 4/2021 | Ma | H01B 17/52 |
| 11,289,521 | B2 | 3/2022 | Wang et al. | |
| 11,329,480 | B1 * | 5/2022 | Cappelletti | H01T 4/04 |
| 2004/0065456 | A1 | 4/2004 | Belli et al. | |
| 2008/0098586 | A1 * | 5/2008 | Muller | H01R 43/015 29/566.4 |
| 2011/0176782 | A1 | 7/2011 | Parris | |
| 2015/0099411 | A1 | 4/2015 | Yang et al. | |
| 2015/0293321 | A1 | 10/2015 | Blazer et al. | |
| 2017/0356132 | A1 | 12/2017 | Stahl et al. | |
| 2022/0048626 | A1 | 2/2022 | Yarnold et al. | |
| 2023/0399797 | A1 | 12/2023 | Barry et al. | |
| 2024/0296977 | A1 | 9/2024 | Woods | |

FOREIGN PATENT DOCUMENTS

| | | | |
|---|---|---|---|
| CA | 3248693 | | 5/2025 |
| CN | 103545752 | A | 1/2014 |
| CN | 106496750 | A | 3/2017 |
| CN | 218449187 | U | 2/2023 |
| DE | 10016536 | A1 | 10/2001 |
| EP | 0858082 | | 8/1998 |
| GB | 2165368 | | 4/1986 |
| GB | 2513991 | | 11/2014 |
| JP | 4312128 | B2 | 3/2006 |
| JP | 2023001697 | A | 1/2023 |
| NZ | 336984 | | 3/1998 |
| WO | WO99/033070 | | 7/1999 |

* cited by examiner

500

500

DIELECTRIC ROPE WITH SHEDS

FIELD OF THE INVENTION

The present disclosure pertains to the field of dielectric equipment, and more particularly to ropes for supporting loads during electrical work in contact with, or in close proximity to energized sources.

BACKGROUND

Insulating ropes (commonly referred to as "dielectric ropes", "insulative ropes", "dielectric cables", "insulating cables", or "insulative cables") are used to protect workers on high-voltage transmission lines, power stations, and other energized work environments from electric shocks and other dangers posed by the presence of high voltages. They may be used in multiple applications, including live line working ropes, bare hand work, tag lines, hand lines, pulling and stringing, evacuation and rescue, rope access, helicopter lift (helicopter longlines), safety netting and high strength insulating tool replacements.

These insulating ropes must keep workers safe even in the event that they come into contact with high voltage conductors or become energized through induction. In addition to having a low dielectric constant, i.e., a high dielectric strength, the mechanical properties of these ropes must be suited to their application, for example tensile strength and flexibility. This imposes certain practical constraints on their manufacture.

During maintenance work on energized and tensioned equipment, strain link sticks are generally used. Strain link sticks provide electrical insulation, rigidity and strain resistance, allowing maintenance crews to work on components such as transmission line insulators.

Strain link sticks, however, are cumbersome to transport and store. There is accordingly a need for improved electrical equipment maintenance tools that are electrically insulating, portable and adaptable to working conditions.

SUMMARY OF THE INVENTION

According to a broad aspect, an insulating rope comprises a non-conductive core, an impermeable non-conducting jacket disposed around the core, the rope having a first end and a second end, each one of the first end and the second end comprises means for securing the rope to an object, and one or more sheds comprising a first portion, and a second portion configured to be secured to the first portion; when the second portion is secured to the first portion, the one or more sheds define an aperture for receiving the rope therein.

In some embodiments, the rope further comprises at least one substantially rigid termination member sealingly enveloping at least a portion of the rope proximate at least one of the first end or the second end.

In some embodiments, the one or more sheds are configured to be secured to the termination member.

In some embodiments, the termination member defines one or more grooves and an inner diameter of the one or more grooves substantially corresponds to a diameter of the aperture.

In some embodiments, one of the termination member and the one or more sheds comprise fastening means configured to complementarily engage the other one of the termination member and the one or more sheds.

In some embodiments, the core comprises ultra-high molecular weight polyethylene fibers.

In some embodiments, the fibers are braided.

In some embodiments, the core comprises fibers of two or more non-conducting materials selected from the group consisting of ultra-high molecular weight polyethylene, polyester, and aramid.

In some embodiments, the first portion and the second portion define couplers, the couplers of the first portion being complementary to the couplers of the second portion and configured to engage therewith.

In some embodiments, the first portion and the second portion are configured to receive one or more screws extending between the first portion and the second portion for securing the first portion to the second portion.

In some embodiments, the one or more sheds comprise one or more of Ultra-High Molecular Weight Polyethylene, cast nylon, polyurethane, polytetrafluoroethylene, polyvinylchloride, polyvinyl ether, polypropylene, nylon, polycarbonate, HDPE, fiberglass, fiber-reinforced polymer, polyurethane, glass and ceramic In some embodiments, the rope comprises at least one shed proximate the first end and at least one shed proximate the second end, the at least one shed having a first outer diameter at a narrow shed end and a second outer diameter at a wide shed end, the second outer diameter being greater than the first outer diameter.

In some embodiments, a longitudinal direction from the wide shed end to the narrow shed end extends towards a most proximate of the first and second ends of the rope.

In some embodiments, a longitudinal direction from the wide shed end to the narrow shed end extends towards one of the first and second ends of the rope.

According to a broad aspect, an insulating rope comprises a non-conductive core, an impermeable non-conducting jacket disposed around the core, the rope having a first end and a second end, each one of the first end and the second end comprising a substantially rigid termination member, and one or more sheds substantially permanently secured to at least one of the impermeable jacket and the termination, the one or more sheds comprising a thermo-retractable material.

DETAILED DESCRIPTION

Figure 1A:
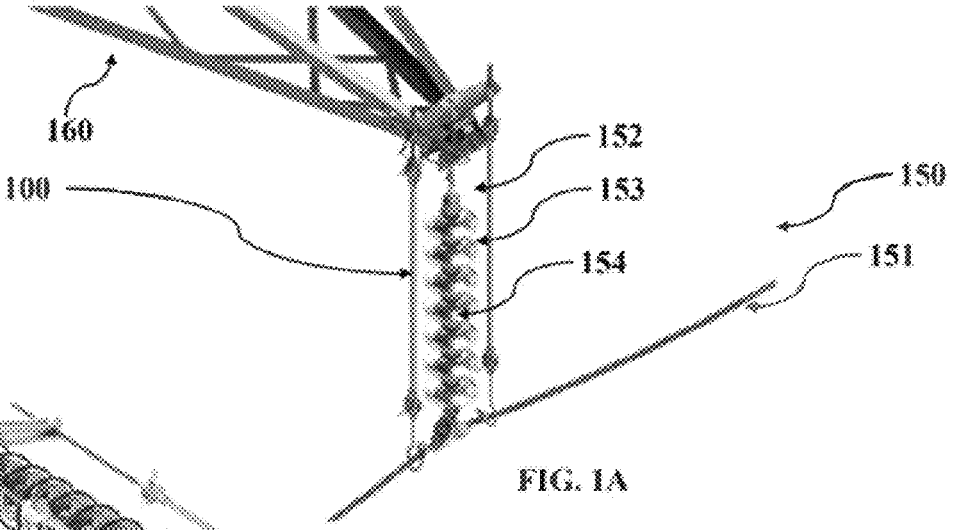
FIGS. 1A and 1B show exemplary uses of a dielectric rope according to an embodiment.

Exemplary embodiments of the present disclosure are presented. Referring to FIG. 1, a dielectric rope 100 is used during maintenance of a high-voltage electric line 150. The electric line 150 comprises an electric conductor 151, a suspension system 152 comprising a suspension insulator 153, supporting the electric conductor 151 from a transmission tower 160.

The suspension insulator 153 comprises a plurality of sheds 154 for dispersing electric streamers which, in the absence of dispersion, may cause an electric arc between the conductor 151 and the tower 160.

The insulator 153 or components of the suspension system 152 may require periodic or urgent maintenance. For example, one or more of the sheds 154 may break or crack following extreme weather events. Strong winds, snow or freezing rain may cause the conductor 151 load to increase. This may damage connectors or fasteners linking the insulator 153 to the conductor 151, to the transmission tower 160, or both.

Use of the dielectric rope 100 may facilitate maintenance of the insulator 153 by sustaining at least a portion of the load exerted on the insulator 153 by the conductor 151 through the dielectric rope 100. In the embodiment illustrated in FIG. 1A, two dielectric ropes 100 extend between the tower 160 and the conductor 151 such that, if the insulator 153 or any portion of the suspension system 152 is loosened and/or disconnected, the conductor 151 will remain suspended from the tower 160 at substantially the same distance. Accordingly, reconnecting the suspension system 152 and/or the insulator 153 to the conductor 151, the tower 160 or both can be simplified.

Figure 1B:
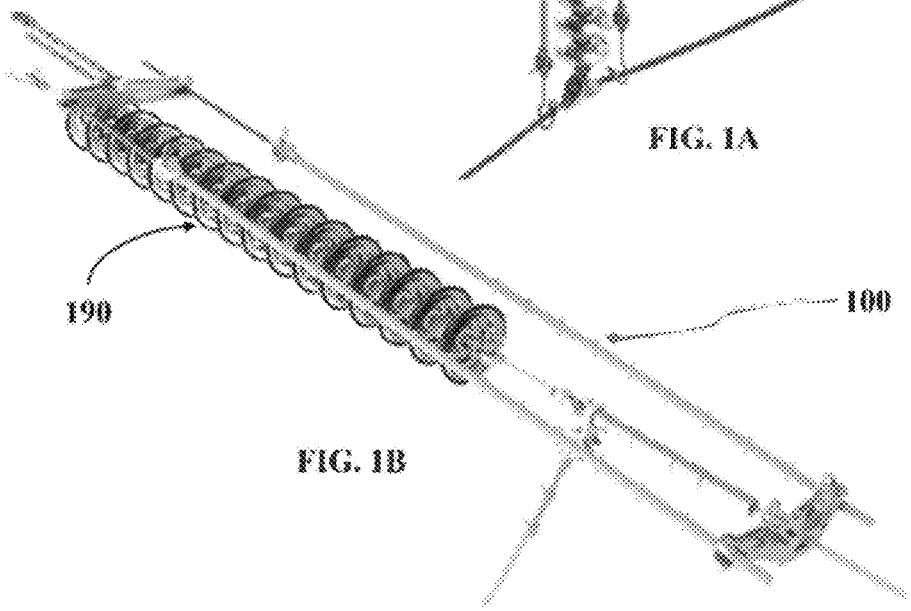

Referring to FIG. 1B, the dielectric ropes 100 may be used during maintenance of an anchoring insulator 190 or other anchoring equipment proximate to an energized power source or an electric conductor. The principles discussed above are applicable with the necessary adaptations to maintenance of the anchoring insulator 190. In general, the ropes 100 may be used to replace or to reduce the tension exerted on the insulator 190 such that the insulator 190 and/or any assembly or equipment attached thereto or dependent therefrom may be maintained.

Figure 2:
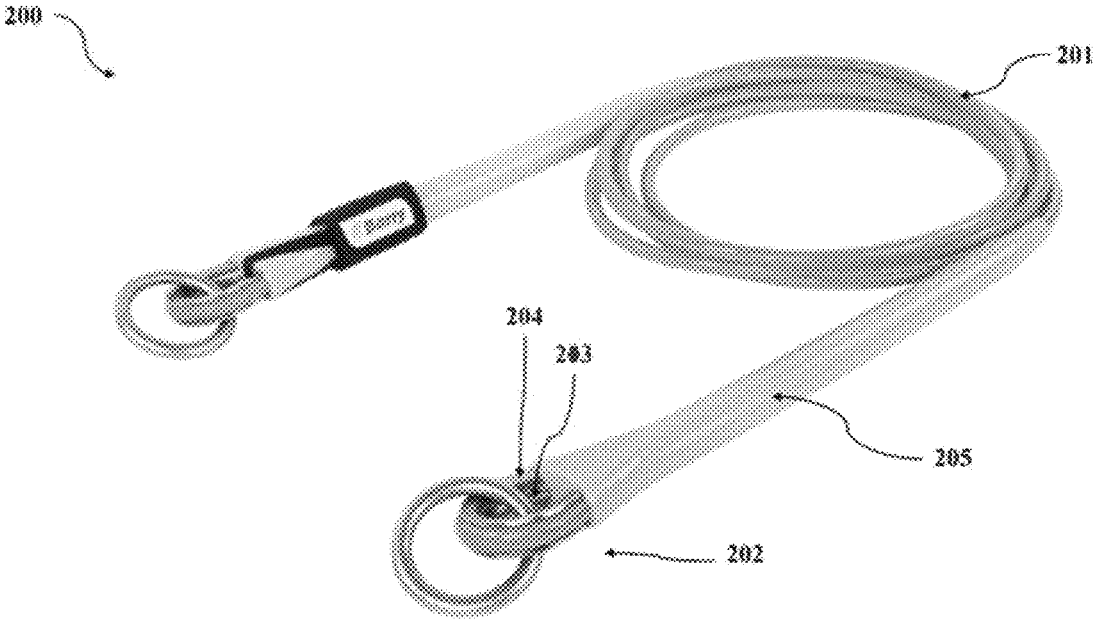
FIG. 2 shows an exemplary dielectric rope without sheds.

Referring now to FIG. 2, an exemplary dielectric rope 200 comprises a length of rope 201 extending between two ends 202. At least one of the ends 202 may comprise a terminus comprising a loop 203 formed by a portion of the length of rope 201, optionally with the use of a loop ring 204. The dielectric rope 200 further comprises terminations 205 extending over a portion of the length of rope 201 and of the loop 203.

The terminations 205 may comprise rubber, plastic, one or more polymers and/or one or more waterproof materials. For example, the terminations may envelop the portion of the dielectric rope 200 where the length of rope 201 is split to form the loop 203, and/or where the length of rope 201 is configured to receive an end 202 such that a loop 203 is formed. It is understood that such portions of the dielectric rope 201 may be vulnerable to fraying, wear, deterioration and/or water and/or debris infiltration. For example, at least a portion of a braided external layer of the rope 201 may be split, and/or an external coating, such as a polymer coating, may be cut to split the rope 201 to form the loop 203, or to receive the end of the rope 201 thereby forming the loop 203.

Accordingly, the terminations 205 provide a substantially watertight barrier between the environment and a possible source of weakness and/or infiltration in the rope length 201.

The terminations 205 may furthermore provide rigidity to the rope 200 for reducing stress and/or strain near the loops 203. For example, in the case of maintenance on an electric line in high winds, the conductor such as the conductor 151 may sway, exerting a force on the dielectric rope 200 in directions other than downwardly. This may cause tension, wear and/or breakage at or around the loop 203 such as due to structural deterioration of the rope at the splice and/or seal point, or stress due to forces being exerted on the loop ring 204 and thereby transferred to the portion of the rope length 201 comprised in the loop 203.

The terminations 205 reduce or substantially prevent the tension, breakage and/or deterioration above by holding the loop 203, the loop ring 204 and a portion of the rope length 201 substantially rigidly in a straight configuration, and the conductor's sway is transferred to a different portion of the rope length 201.

Figure 3A:
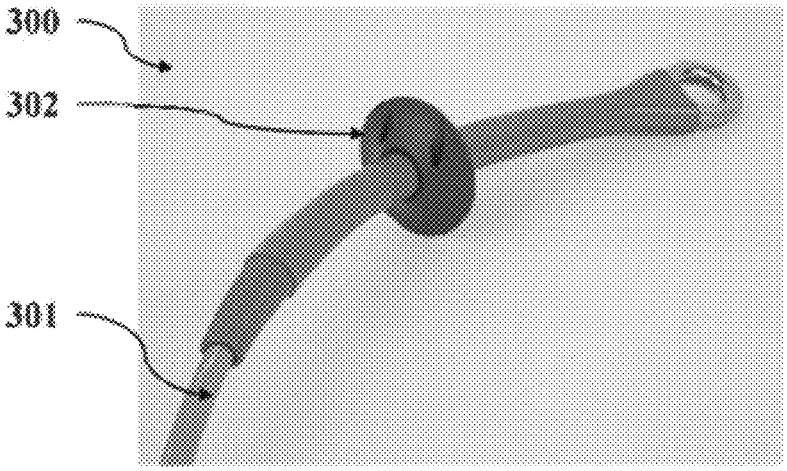
FIGS. 3A and 3B show details of exemplary dielectric ropes with a shed according to an embodiment.
Figure 3B:
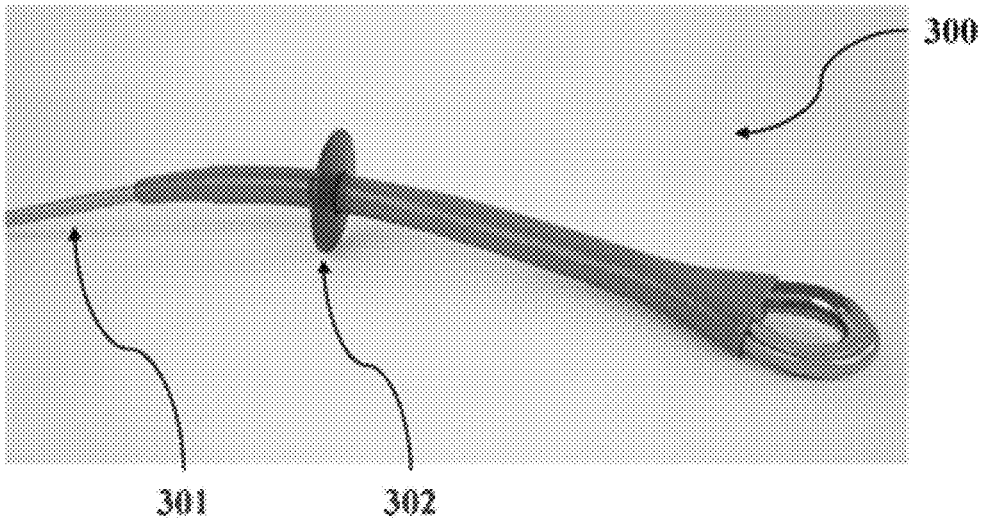

Referring now to FIGS. 3A and 3B, details of exemplary dielectric ropes 300 show a portion of a rope length 301 and a shed 302.

Shed design affects streamer propagation and reduces the risk of flashover and accordingly affects personnel safety. In general, two types of streamers have been identified: surface streamers and air streamers.

The shape of shed curves significantly affects the movement of electrical streamers. Specifically, curved, larger sheds with a smaller fillet radius effectively block surface streamers, while air streamers can bypass the shed. Shed shape plays a role in determining streamer paths. Sharper curves reduce streamer stability, whereas larger curves allow for faster propagation. These factors directly influence flashover risks, with material properties also affecting the streamer's velocity.

Shed design can accordingly increase the electric field required for streamer propagation, making it more difficult for streamers to form and travel. Ultimately, shed design can effectively reduce the occurrence of flashovers.

Figure 4A:
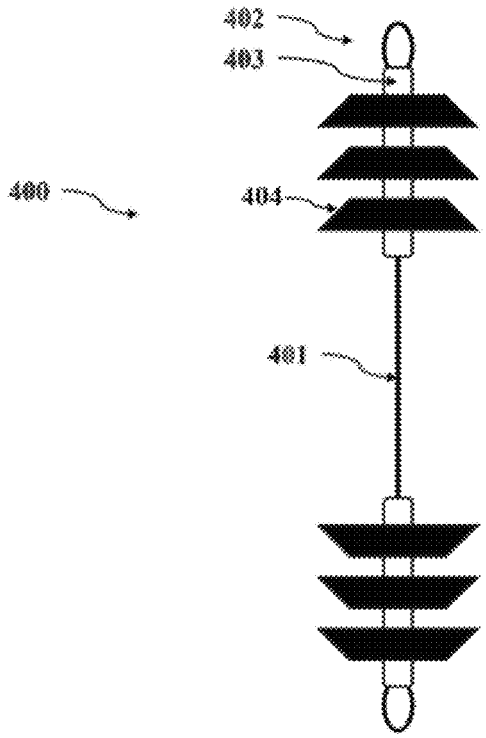
FIGS. 4A and 4B show exemplary dielectric ropes with a plurality of sheds according to an embodiment.
Figure 4B:
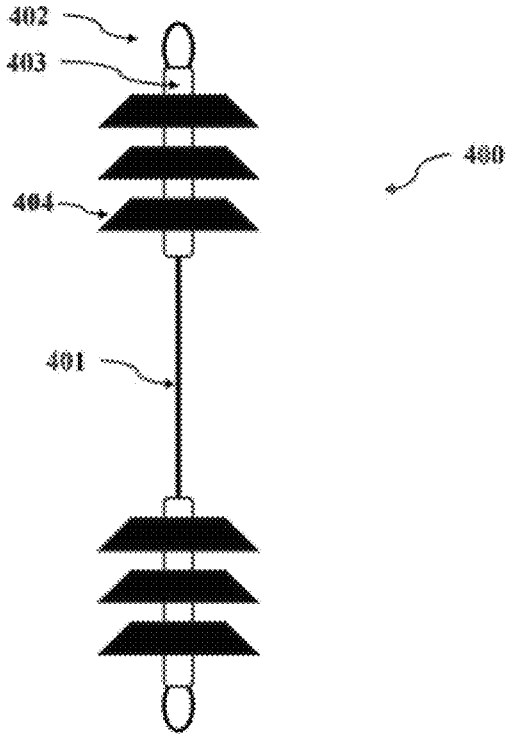

Referring now to FIGS. 4A and 4B, an exemplary dielectric rope with sheds 400 comprises a rope length 401 extending between two endings 402, the endings 402 being configured for securing the dielectric rope 400 to electrical equipment and/or conductors.

The dielectric rope comprises terminations 403 which may be similar to the terminations described above. One or more sheds 404 is installed on the terminations 403 proximate to the endings 402. It is understood that the terminations 403 may be omitted and the sheds 404 may be provided on the rope length 401.

The sheds disclosed herein optimize the shape, dimensions, and materials to efficiently hinder streamer propagation. The sheds may be placed on both the energized, or conductor-adjacent side and the ground, or tower side of the rope 400 to provide additional protection. This approach may prevent streamers from traveling in either direction, as streamers can originate from areas near the energized side or from the lineman or tower.

As shown in FIG. 4A, a plurality of sheds 404 is installed at both ends of the rope 400, any given shed having a decaying profile narrowing in the direction of the nearest ending 402 and widening towards the midpoint of the rope length 401. In the embodiment illustrated in FIG. 4B, the sheds 404 are installed on the terminations 403 having their respective profiles decaying in the same direction.

In some embodiments, the sheds 404 may be removable and comprise a plurality of portions configured to be secured to each other for forming a shed around the rope length 401. In another embodiment, the sheds 404 may be permanently affixed and may be made of a thermo-retractable material which may also use a glue or other form of material to remain secured and fixed to the rope or termination.

Figure 5:
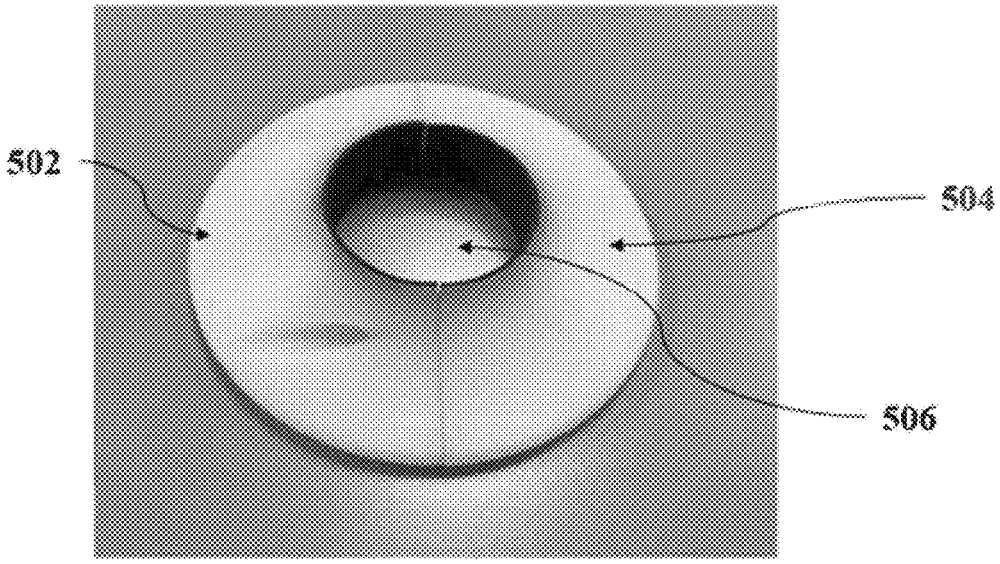
FIG. 5 shows an exemplary shed according to an embodiment.

Referring to FIG. 5, a shed 500 may be divided into a first portion 502 and a second portion 504. The shed 500 may include other components, however such components have been omitted from FIG. 5 for simplicity.

The portion 504 may be configured to be coupled to the first portion 502. In certain non-limiting embodiments, the second portion 504 may be detachably coupled to the first portion 502. The second portion 504 when coupled to the first portion 502 may define an aperture 506 configured to receive a rope, for example the dielectric rope 100, 200, 300 or 400. Even though the illustrated aperture 506 has a circular shape, in various other embodiments, the aperture 506 may have any suitable shape for receiving the rope according to the rope's profile and/or cross-section, such as, oval, triangular, square, rectangular, or the like.

The shed 500 may be constructed of any suitable robust material that has a low dielectric constant (k) value, such as, for example, Polypropylene, Nylon, Polycarbonate, HDPE, cast nylon (Nycast), Fiberglass, FRP, Ultra-High Molecular Weight Polyethylene (UHMWPE), Polytetrafluoroethylene (PTFE), Polyvinyl Ether (PVE), polyvinylchloride (PVC), polyurethane, ceramic, and/or other man-made synthetic materials and composites or the like.

The shed 500 may be fabricated using premium materials known for their outstanding non-tracking characteristics, insulation properties, and long-term service dependability. Additionally, the shed 500 may exhibit favorable physical attributes, robust aging stability, and resistance to factors such as wear and tear, chemicals, and ultraviolet (UV) radiation. Further, the surface of the shed 500 may provide a high luster for beading of moisture that causes water or moisture to form into small, round droplets rather than spreading out or adhering to the surface.

Figure 6:
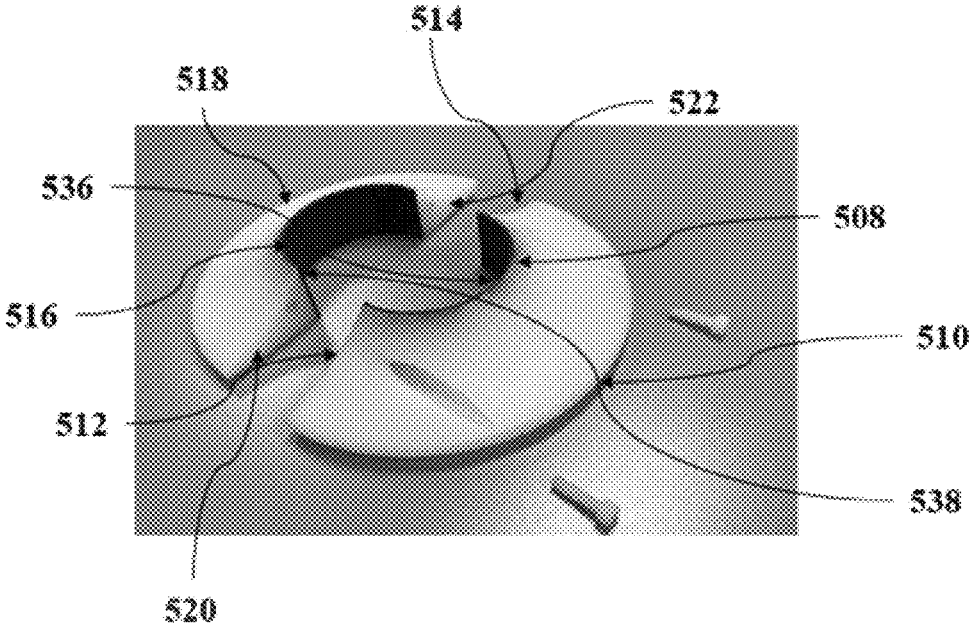
FIG. 6 is an exploded view of the shed of FIG. 5.

FIG. 6 illustrates an exploded view of the shed 500, in accordance with various non-limiting embodiments of the present disclosure. As shown, the first portion 502 may have a first inner portion 508 and a first outer portion 510. The first inner portion 508 may have a first wall 512 and a second wall 514. The first wall 512 and the second wall 514 may be separated by a first predefined distance. The first inner portion 508 may further comprise a first inner sector 536 contracting radially between the first wall 512 and the second wall 514. The first predefined distance may be equal to the diameter of the first inner sector 536. The first inner sector 536 may be provided with a layer of elastic material, for example, rubber, to enhance a grip of shed 500 on the rope. Further, the first outer portion 510 may be defined by a first outer sector radially extending from the first wall 512 to the second wall 514.

In a similar manner, the second portion 504 (not numbered in FIG. 6) may have a second inner portion 516 and a second outer portion 518. The second outer portion 518 may be defined by the second outer sector. The second inner portion 516 may have a third wall 520 and a fourth wall 522. The third wall 520 and the fourth wall 522 may be separated by a second predefined distance. The second inner portion 516 may further comprise a second inner sector 538 contracting radially between the third wall 520 and the fourth wall 522. The second predefined distance may be equal to the diameter of the second inner sector 538. The second inner sector 538 may be provided with a layer of elastic material, for example, rubber, to enhance a grip of the shed 500 on the rope. Further, the second outer portion 518 may be defined by a second outer sector radially extending from the third wall 520 to the fourth wall 522. When assembled, the shed 500 may define an aperture having a diameter, or at least one axial width, of between 0.5 inch and 4 inches, for example between about 1¾ inches and 3 inches.

The first inner sector 536 and the second inner sector 538 may be provided with a resilient and/or compressible layer or liner (not shown) configured to contact the rope for reducing voids and/or for improving the watertightness of the shed 500. It is understood that fluids and air may conduct electricity and thereby contribute to personnel injury due to current leakage and flashovers. The resilient and/or compressible layer is provided on an inner face of the inner sectors 536, 538 such that, when the shed 500 is installed on a rope, the resilient and/or compressible layer is at least partly compressed between the rope and the inner sectors 536, 538. The presence of air gaps is thereby reduced and fluids are substantially prevented from infiltrating between the rope and the shed 500. The compressible material may comprise rubber, neoprene, polyurethane and/or other suitable materials for providing watertightness and electric insulation.

The sheds such as the shed 500 may be secured to the terminations such as terminations 403 of the rope 400 using acceptable means. For example, the terminations 403 may be configured to receive one or more dielectric screws for securing the shed 500 thereon. In some embodiments, the terminations 403 may comprise one or more dielectric or otherwise insulating fasteners configured to engage complementary features on the one or more sheds 500, such as holes, grooves, ribs, protrusions, brackets, and the like. In some embodiments, the terminations 403 may define grooves, depressions or notches for receiving a portion of the shed 500 therein. Accordingly, once the shed 500 is assembled on the termination 403, it may be held in place by a difference in diameter between the inner diameter of the groove of the termination 403, substantially corresponding to the inner diameter of the aperture defined by the shed 500, and the portion of the termination 403 outside the groove. In some embodiments, the shed 500 may be provided with a resilient and/or elastic material on the inner sector extending radially inward such that, when the shed 500 is assembled on the termination 403, the elastic or resilient material is compressed between the shed 500 and the termination 403, thereby securing the shed 500 by compressive force.

In general the sheds 500 may have any side cross-section. For example the sheds 500 may be substantially oval in shape, defining a maximum outer diameter at a center of the shed. In embodiments, the sheds may define a sloped or decaying profile, from a narrower outer diameter to a wider outer diameter. Without limiting the scope of the present disclosure, the narrower portion of the shed may be considered a top portion, and the wide portion of the shed may be considered a bottom portion.

Figure 7:
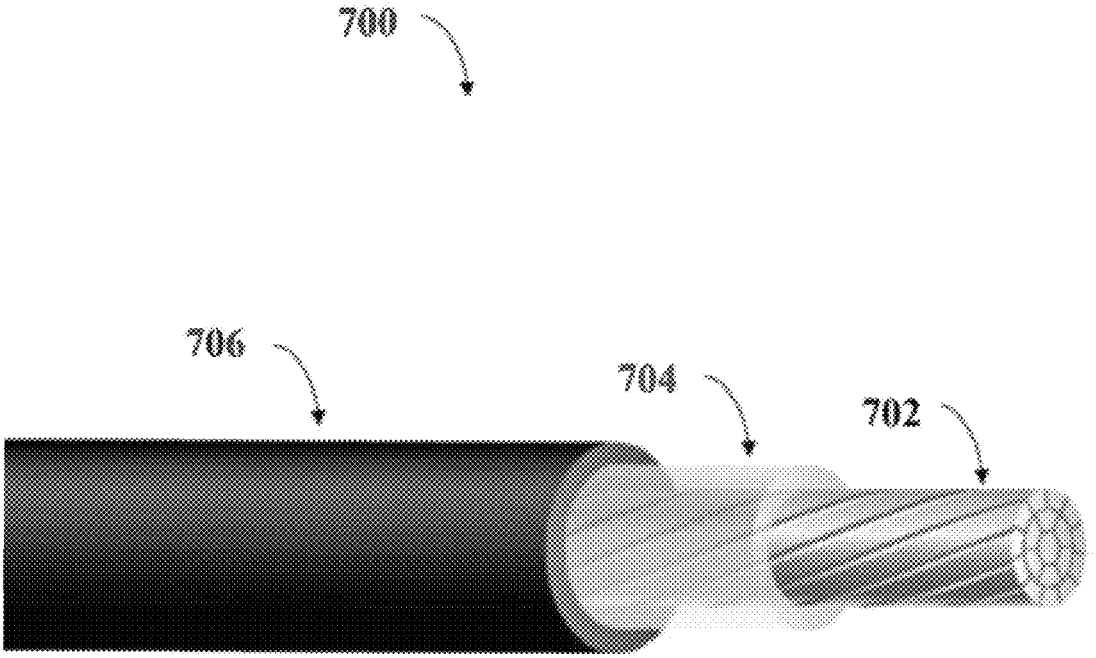
FIG. 7 is an exemplary dielectric rope according to an embodiment.

Referring now to FIG. 7, an exemplary dielectric rope 700 according to an embodiment comprises a fiber core 702, which may be composed of any suitable dielectric material having a high tensile strength. Typical materials may include but are not limited to ultra-high-molecular-weight polyethylene (UHMWPE), polyester, and/or aramid fibers (sometimes sold under the Kevlar™ brand). For example, the core may comprise Dyneema™ or Spectra™ fibres. The core may be braided, for example comprising a 16-strand braid. Other braiding patterns and other configurations are possible. The core may comprise between 10% and 90% HMPE, for example between 25% and 75% HMPE, for example between 40% and 60% HMPE, and/or polyester. The rope 700 may comprise a braid cover (not shown) disposed on the core 702. The braid cover may have a kermantle construction and may be a single braid or double braid construction. The braid cover may comprise polyester and/or other suitable fibers.

It should be understood that any suitable material or materials may be used for the core 702, provided that the material or materials have tensile strength appropriate for sustaining the weight of an electric transmission conductor and insulating properties that prevent current leakage or conduction when the rope 700 is in contact with an energized high-voltage source. The fibers of the core 702 may be twisted into yarns and then cable-laid (twisted) or braided, to ensure a high tensile strength suitable for various different types of use.

Outside the core 702 is a water adsorbent layer 704. The water adsorbent layer 704 contains a water adsorbent substance, for example a micro sieve material such as a zeolite or a metal-organic framework (MOF). It should be understood that any suitable material or materials may be used for the water adsorbent layer 704, provided that it has water adsorbent properties and does not reduce the insulating properties of the rope 700. For example, the water adsorbent layer 704 may comprise a desiccant gel, an aluminosilicate, solid desiccants and/or other suitable hygroscopic materials. The water adsorbent layer 704 may comprise a natural zeolite and/or a synthetic zeolite, for example analcime, chabazite, clinoptilolite, erionite, mordenite, phillipsite, ferrierite, Linde-type zeolites, ZSM-5 and SSZ-32 zeolites.

Outside the water adsorbent layer 704 is a thermoplastic jacket 706. The thermoplastic jacket 706 is hydrophobic and prevents water or moisture from permeating coming into contact with the core 702. It should be understood that any suitable material or materials may be used for the thermoplastic jacket 706, provided that it is hydrophobic, durable and flexible.

The dielectric ropes according to the present disclosure have generally low leakage currents in both dry and wet conditions. In some embodiments, the ropes have a leakage current of less than 20 microamperes per 100 kV root mean square (RMS) in wet conditions and in dry conditions as tested according to ASTM F-1701-12 (2024) "Standard Specification for Unused Ropes with Special Electrical Properties" and to IEC 62192:09 "Live working-Insulating ropes".

The dielectric ropes according to the present disclosure are generally flexible and easy to transport, for example by being rolled or spooled. Compared to conventional strain links, the ropes according to the present disclosure are lighter, more portable, and easier to handle.

The dielectric ropes according to the present disclosure provide flexibility and adaptability to working conditions by allowing users to install one or more creepage extender sheds having any profile, any diameter and made of any material, including but not limited to glass, ceramic, rubber and/or polymers.

The ropes according to the present disclosure provide a substantially watertight, flexible and adaptable alternative to strain links.

The invention claimed is:

1. An insulating rope comprising:

a non-conductive core;

an impermeable non-conducting jacket disposed around the core;

the rope having a first end and a second end, each one of the first end and the second end comprising means for securing the rope to an object; and one or more sheds, the one or more sheds comprising:

a first portion; and a second portion configured to be secured to the first portion;

wherein, when the second portion is secured to the first portion, the one or more sheds define an aperture for receiving the rope therein; and at least one substantially rigid termination member sealingly enveloping at least a portion of the rope proximate at least one of the first end or the second end, wherein the one or more sheds are configured to be secured to the termination member.

2. The rope according to claim 1, wherein the termination member defines one or more grooves and wherein an inner diameter of the one or more grooves substantially corresponds to a diameter of the aperture.

3. The rope according to claim 1, wherein one of the termination member and the one or more sheds comprises fastening means configured to complementarily engage the other one of the termination member and the one or more sheds.

4. The rope according to claim 1, wherein the core comprises fibers of at least one of ultra-high molecular weight polyethylene, polyester and aramid.

5. The rope according to claim 4, wherein the fibers are braided.

6. The rope according to claim 1, wherein at least one of:

the first portion and the second portion define couplers, the couplers of the first portion being complementary to the couplers of the second portion and configured to engage therewith, and the first portion and the second portion are configured to receive one or more screws extending between the first portion and the second portion for securing the first portion to the second portion.

7. The rope according to claim 1, wherein the one or more sheds comprise one or more of Ultra-High Molecular Weight Polyethylene, cast nylon, polytetrafluoroethylene, polyvinylchloride, polyvinyl ether, polypropylene, nylon, polycarbonate, High-Density Polyethylene, fiberglass, fiber-reinforced polymer, polyurethane, glass and ceramic.

8. The rope according to claim 1, comprising at least one shed proximate the first end and at least one shed proximate the second end, wherein the at least one shed has a first outer diameter at a narrow shed end and a second outer diameter at a wide shed end, the second outer diameter being greater than the first outer diameter.

9. The rope according to claim 8, wherein a longitudinal direction from the wide shed end to the narrow shed end extends towards a most proximate of the first and second ends of the rope.

10. The rope according to claim 8, wherein a longitudinal direction from the wide shed end to the narrow shed end extends towards one of the first and second ends of the rope.

11. An insulating rope comprising:

a non-conductive core;

an impermeable non-conducting jacket disposed around the core;

the rope having a first end and a second end, each one of the first end and the second end comprising means for securing the rope to an object; and one or more sheds, the one mor more sheds comprising:

a first portion; and a second portion configured to be secured to the first portion;

wherein, when the second portion is secured to the first portion, the one or more sheds define an aperture for receiving the rope therein; and wherein the one or more sheds comprise one or more of Ultra-High Molecular Weight Polyethylene, cast nylon, polytetrafluoroethylene, polyvinylchloride, polyvinyl ether, polypropylene, nylon, polycarbonate, High-Density Polyethylene, fiberglass, fiber-reinforced polymer, polyurethane, glass and ceramic.

12. The insulating rope according to claim 11, further comprising at least one substantially rigid termination member sealingly enveloping at least a portion of the rope proximate at least one of the first end or the second end.

13. The insulating rope according to claim 12, wherein the one or more sheds are configured to be secured to the termination member.

14. The insulating rope according to claim 13, wherein one of the termination member and the one or more sheds comprises fastening means configured to complementarily engage the other one of the termination member and the one or more sheds.

15. The insulating rope according to claim 11, wherein the core comprises fibers of at least one of ultra-high molecular weight polyethylene, polyester and aramid.

16. The insulating rope according to claim 15, wherein the fibers are braided.

17. The insulating rope according to claim 11, wherein at least one of:

the first portion and the second portion define couplers, the couplers of the first portion being complementary to the couplers of the second portion and configured to engage therewith; and the first portion and the second portion are configured to receive one or more screws extending between the first portion and the second portion for securing the first portion to the second portion.

18. The insulating rope according to claim 11, comprising at least one shed proximate the first end and at least one shed proximate the second end, wherein the at least one shed has a first outer diameter at a narrow shed end and a second outer diameter at a wide shed end, the second outer diameter being greater than the first outer diameter.

19. The insulating rope according to claim 18, wherein a longitudinal direction from the wide shed end to the narrow shed end extends towards a most proximate of the first and second ends of the rope.

20. The insulating rope according to claim 14, wherein a longitudinal direction from the wide shed end to the narrow shed end extends towards one of the first and second ends of the rope.

* * * * *